US005284070A

United States Patent [19]

Rieck

[11] Patent Number: 5,284,070

[45] Date of Patent: Feb. 8, 1994

[54] NAILING SHIELD AND NAIL SET FOR USE IN DRIVING NAILS

[75] Inventor: Kenneth J. Rieck, Fairport, N.Y.

[73] Assignee: Johnson Level & Tool Mfg. Co., Inc., Mequon, Wis.

[21] Appl. No.: 14,636

[22] Filed: Feb. 8, 1993

[51] Int. Cl.[5] ..... B25C 3/00

[52] U.S. Cl. ..... 81/44; 227/135

[58] Field of Search ..... 81/44; 173/90; 227/135, 227/136

[56] References Cited

U.S. PATENT DOCUMENTS

| | | |
|---|---|---|
| Re. 281,59 | 9/1974 | Litz . |
| 337,905 | 3/1886 | Wheelock . |
| 1,016,383 | 2/1912 | Wellman . |
| 2,878,476 | 3/1959 | Auchard . |
| 3,338,279 | 8/1967 | Kruttschnitt . |
| 4,079,764 | 3/1978 | Hayes . |
| 4,422,489 | 12/1983 | Ross . |
| 4,493,353 | 1/1985 | Thomas . |
| 4,966,056 | 10/1990 | Miller . |
| 4,967,623 | 11/1990 | Jackson . |

*Primary Examiner*—James G. Smith

*Attorney, Agent, or Firm*—Andrus, Sceales, Starke & Sawall

[57] ABSTRACT

A nail starter/shield is adapted for use in combination with a nail set and a hammer for driving fasteners such as nails into boards. The nail starter/shield includes a body and a head. The head is provided with nail retaining structure for retaining one or more nails in position relative to the workpiece, for starting the nails into the workpiece. After the nails are started, the head is disengaged from the nails. The body is provided with a slot, and the nail starter/shield is repositioned such that the nails are located within the slot. The nails are then driven into the board while the nails are disposed within the slot, with the body functioning to prevent the hammer from striking the board during driving of the nails. After the nail heads are driven in close proximity to the upper surface of the body, the nail starter/shield is withdrawn and a nail set is used to complete driving of the nails and to embed the nail heads into the board. The body defines parallel side edges which are spaced apart a distance substantially equal to the width of the board, such that aligning the side edges of the body with the side edges of the board results in positioning the nails in predetermined locations relative to the board.

11 Claims, 2 Drawing Sheets

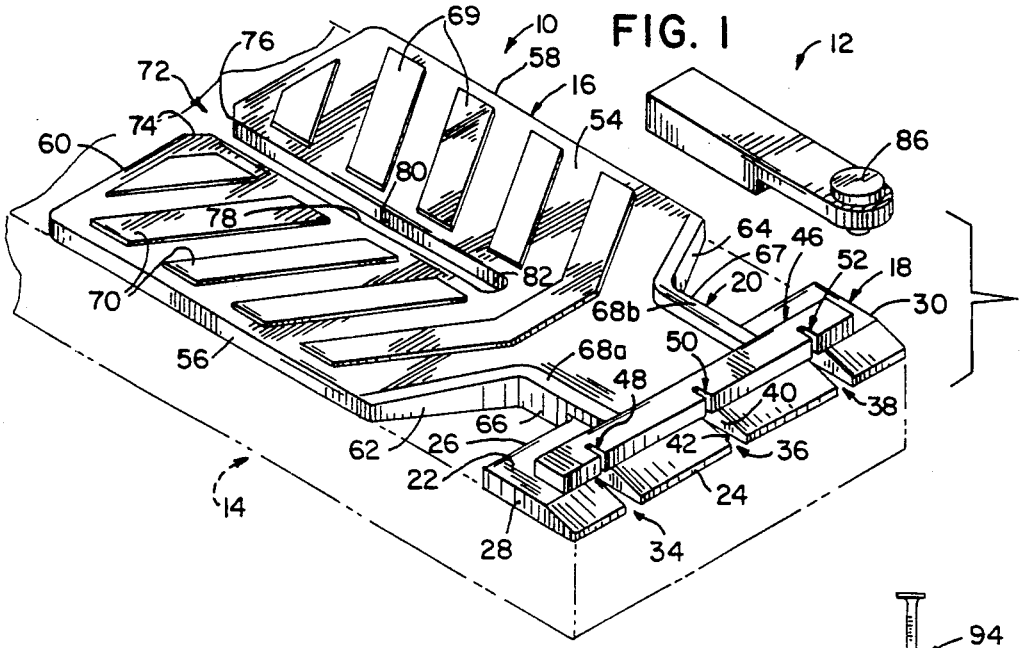
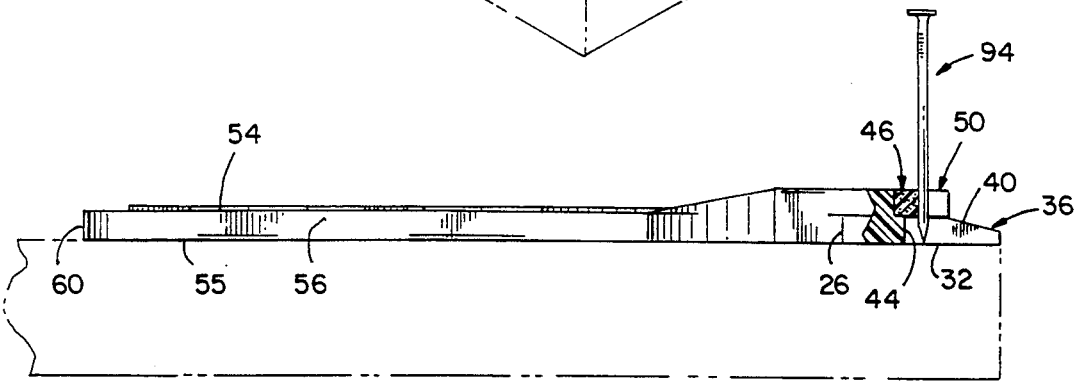
FIG. 2
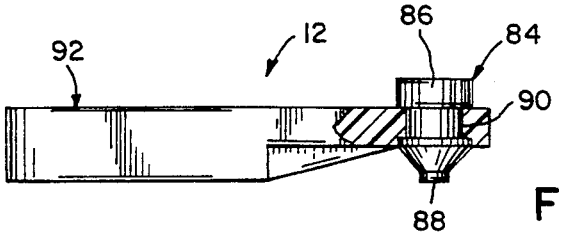
FIG. 3

NAILING SHIELD AND NAIL SET FOR USE IN DRIVING NAILS

BACKGROUND AND SUMMARY

The invention pertains to a nail starter and nailing shield for use in combination with a harder and a nail set for driving nails into a workpiece.

It is well known to use a hammer for driving fasteners such as nails into a workpiece such as a board. In driving nails, one problem which arises is retaining the nail in place prior to initially striking the nail head with the hammer to start the nail. Numerous nail holders are known for accomplishing this task. Another problem in driving nails is that it is not uncommon for the head of the hammer to slip off the head of the nail when the hammer is swung at the nail. This results in the hammer striking the workpiece, leaving an unsightly indentation in the workpiece. Various nailing shield devices have been developed to address this problem.

It is an object of the present invention to solve the above-identified problems by providing a combination nail holder and nailing shield which is simple in its construction and operation. Yet another object of the invention is to provide a nail holder capable of holding several nails in place on a workpiece, and a shield for use when driving the several nails into the workpiece. Yet another object of the invention is to provide a nail holder which is capable of accurately positioning several nails in predetermined locations on the workpiece.

In accordance with one aspect of the invention, a nail starter/shield consists of a body and a head connected to the body, with the head including retaining structure for holding one or more nails in a predetermined position over the workpiece. A slot is formed in the body for receiving the one or more nails therein after the nails are started by initial engagement with the workpiece. The slot accommodates driving of the nails into the workpiece, and the body functions to prevent the hammer from striking the workpiece during driving of the nails. The body defines first and second ends, and the head is connected to the first end of the body. The slot extends inwardly into the body from the second end of the body. The body extends along a longitudinal axis, and the head extends along an axis transverse to the longitudinal axis of the body. The head defines a forward surface, and includes one or more slots extending rearwardly from the forward surface through which the one or more nails extend. The retaining structure is in the form of a resilient member mounted to the head over each of the one or more slots, with a passage being formed in the resilient member through which the nail extends into the slot.

The nail starter/shield of the invention is particularly well suited for use with a workpiece having a predetermined width and defining a pair of parallel spaced side edges. In accordance with another aspect of the invention, the nailing shield defines a pair of side edges which are spaced apart a distance substantially equal to the predetermined width of the workpiece. Preferably, the pair of side edges are defined by the body, and extend substantially the entire extent of the body. With this construction, aligning the side edges of the body with the side edges of the workpiece functions to position the nails in predetermined locations relative to the workpiece. In a particularly preferred form the head, in which the slots are formed and through which the nails extend, also is of a width substantially equal to the predetermined width of the workpiece.

In accordance with yet another aspect of the invention, a method of driving nails into a workpiece comprises providing a nail starter/shield substantially as broadly summarized in the foregoing paragraphs. Nails are engaged with the retaining structure of the nail starter/shield, and each nail is started by partially driving the nail into a workpiece while the nail remains engaged with the retaining structure. The nails are then disengaged from the retaining structure by movement of the body away from the nails, and the body is repositioned such that the partially driven nails are disposed within the slot formed in the body. The nails are then driven into the workpiece through the slot, and the body functions to prevent the hammer from contacting the workpiece during driving of the nails. After the nails are driven such that the heads of the nails are in close proximity to the body, the body is removed and a nail set is employed to fully drive the nails into the workpiece such that the head of each nail is embedded into the workpiece. The nail set preferably consists of a head defining an upwardly facing striking surface and a tip engageable with the head of the nail, and a laterally handle adapted to be grasped by a user for allowing the user's fingers to remain out of the path of the hammer while the nail set is used to fully embed the nail heads into the workpiece.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of the nail starter/shield constructed according to the invention, and a nail set for use therewith in driving nails into a workpiece;

FIG. 2 is a side elevation view, with a portion in section, showing the nail starter/shield of FIG. 1;

FIG. 3 is a side elevation view, with a portion in section, showing the nail set of FIG. 1;

DETAILED DESCRIPTION OF THE INVENTION

Figure 4A:
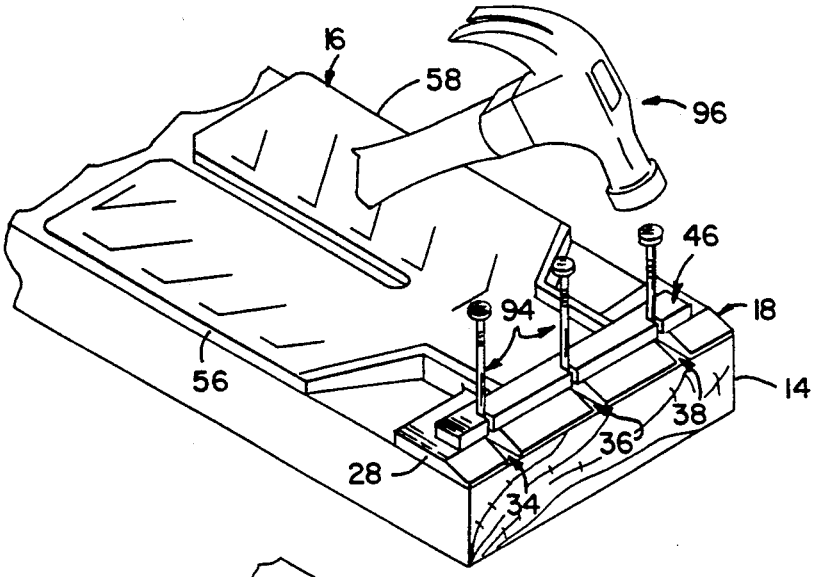
FIGS. 4*a* and 4*b* are isometric views showing the manner in which the nail starter/shield of FIG. 1 are employed in driving nails into a workpiece.

Referring to FIG. 1, a combination nail starter/shield 10 is adapted for use in combination with a nail set 12 for driving fasteners such as nails into a workpiece, shown in phantom at 14.

Nail starter/shield 10 includes a body 16 and a head 18. A neck 20 extends between the forward end of body 16 and the rearward end of head 18 for interconnecting body 16 and head 18.

Head 18 defines an upper surface 22, a forward edge 24, a rearward edge 26, a pair of side edges 28, 30, and a lower surface 32 (FIG. 2). A series of slots, shown generally at 34, 36 and 38 extend rearwardly from forward edge 24 of head 18, extending the full height of head 18 between upper surface 22 and lower surface 32. Slots 34–38 are identical in construction. For example, shown in FIGS. 1 and 2 slot 36 defines a pair of spaced side walls 40, 42 and an end wall 44. Slots 34 and 38 are identical in construction to slot 36.

Slots 34–38 are spaced at equal intervals along the length of head 18. Representatively, head 18 may have a width of 5½ inches and the centerline of slot 36 is midway along the length of forward edge 24 defined spaced 1¾ inches from the centerline of slot 36.

A resilient retainer strip 46 is mounted to upper surface 22 of head 18. Retainer strip 46 may be mounted to upper surface 22 in any satisfactory manner, such as by means of an adhesive applied between the lower surface of strip 46 and upper surface 22. Retainer strip 46 may be any satisfactory material to serve its intended function and in a representative construction may be a polyurethane foam material. Retainer strip 46 is provided with passages in the form of slots 48, 50 and 52 along its length. Slots 48–52 extend rearwardly from the forward surface defined by retainer strip 46, approximately halfway through retainer strip 46 in a front-to-rear direction. The spacing between slots 48–52 is substantially equal to the spacing between slots 34–38 in head 18. Retainer strip 46 is mounted to head 18 such that slots 48–52 are disposed over slots 34–38, respectively, with each of slots 48–52 providing access to slots 34–38, respectively, from the upper surface of retainer strip 46.

As shown in FIGS. 1 and 2, body 16 defines an upper surface 54, a lower surface 55, a pair of parallel side edges 56, 58, and a rear edge 60. Body 16 further defines a pair of angled forward edges 62, 64. Neck 20 defines a pair of side edges 66, 67, which extend between and interconnect forward edges 62, 64 of body 16 and rear edge 26 of head 18. Neck 20 further defines a pair of upstanding ribs 68*a*, 68*b* which extend above the upper surface of neck 20 and above angled forward surfaces 62, 64 and side edges 66, 67 respectively.

A series of oppositely angled ribs 69, 70 are formed integrally with body upper surface 54, extending upwardly therefrom.

A slot, shown generally at 72, extends forwardly into body 16 from its rear edge 60. Slot 72 extends the full height of body 16, between upper surface 54 and lower surface 55. Slot 72 is substantially centrally located along the length of rear edge 60, and a pair of ramped surfaces 74, 76 define the entrance into slot 72 from rear edge 60 of body 16. Slot 72 defines a pair of spaced parallel side walls 78, 80, and an end wall 82.

Body 16 is generally rectangular in plan, extending along a longitudinal axis coincident with the centerline of slot 72. Head 18 is also generally rectangular in plan, with its longitudinal axis extending substantially perpendicularly to the longitudinal axis of body 16.

Body side edges 56, 58 are substantially aligned with head side edges 28, 30. In a particularly advantageous arrangement, nail starter/shield 10 is adapted for use in driving nails into a workpiece 14 such as a board having a predetermined width. For example, workpiece 14 may be a nominal 2 inch by 6 inch piece of lumber, such as is typically used to construct a deck floor. The actual width of such a member is 5½ inches, and body side edges 56, 58 and head side edges 28, 30 are likewise 5½ inches apart. With this arrangement, alignment of head and body side edges 28, 56, respectively with one edge of workpiece 14 and of head and body side edges 30, 58 with the other edge of workpiece 14, positions slots 34, 38 in desired predetermined locations on the upper surface of workpiece 14.

Referring briefly to FIGS. 1 and 3, nail set 12 includes a head 84 defining an upper striking surface 86 and a lower tip 88. Head 84 is preferably constructed of hardened steel, and includes a circumferential groove 90. Head 84 is mounted to the forward end of a plastic handle 92, which is injection molded about head 84. The material of handle 92 is disposed within groove 90 for securely retaining head 84 in place on handle 92. Handle 92 is laterally offset from head 84, so that handle 92 can be grasped by a user for retaining tip 88 in position on the head of a nail, without the user's hand being in the path of the hammer.

Figure 4B:
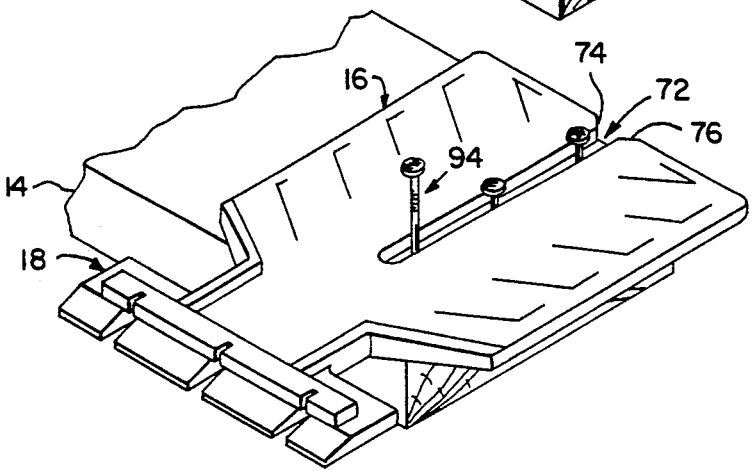
Figure 5A:
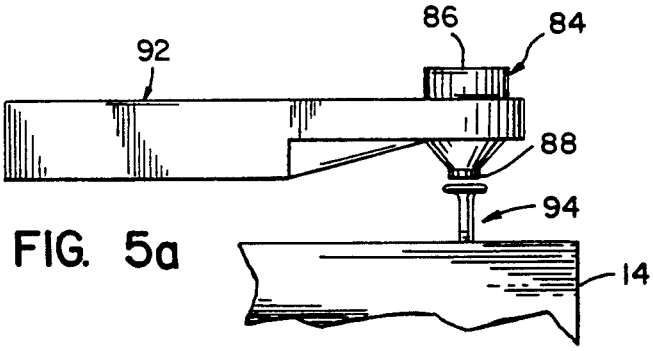
FIGS. 5*a* and 5*b* are side elevation views showing the manner in which the nail set of FIG. 1 is used to embed the nail heads into the workpiece.
Figure 5B:
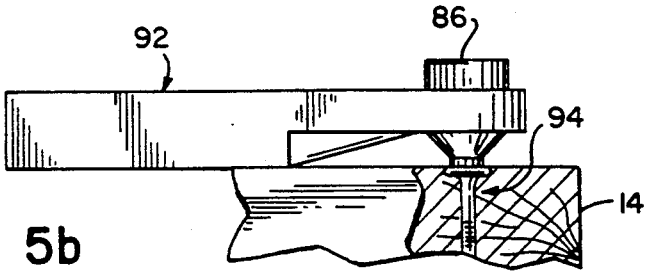

In operation, nail starter/shield 10 and nail set 12 function as follows. Initially, after workpiece 14, such as a 2 inch by 6 inch nominal piece of lumber is positioned in a desired location, nail starter/nailing shield 10 is placed on the upper surface of workpiece 14 as shown in FIGS. 1, 2 and 4A. A series of nails, such as shown at 94, are loaded into head 18 as shown in FIG. 2. The tip of a nail 94 is inserted downwardly through each of passages 48–52 in retaining strip 46 and into slots 34–38, respectively, such that the nail tip is disposed immediately above the upper surface of workpiece 14. The resiliency of retaining strip 46 functions to retain nails 94 in position above workpiece 14. Once head 18 is loaded with nails in this manner, side edges 56, 58 of body 16 and side edges 28, 30 of head 18 are aligned With the side edges of workpiece 14. This functions to place nails 94 at equally spaced intervals relative to the side edges of workpiece 14. The user then retains nail starter/shield 1C in this position, either by using one hand or by kneeling on body 16 and retaining body 16 in place with the use of one knee. The user then employs a hammer, such as shown at 96 in FIG. 4*a*, to start each of nails 94 by striking the head of each nail 94 one or two times with hammer 96. The user then grasps body 16 and draws nail starter/shield 10 rearwardly, resulting in disengagement of nails 94 from head 18 by nails 94 being drawn through passages 48–52 in retaining strip 46 and slots 34–38 in head 18. The user then repositions nail starter/shield 10 to its FIG. 4*b* position, in which nails 94 are disposed within slot 72 of body 16. Ramped surfaces 74, 76 facilitate entry of nails 94 into slot 72. Once nail starter/nailing shield 10 is in its FIG. 4*b* position, the user employs hammer 96 to drive nails 94 into workpiece 14, until the heads of nails 94 are in close proximity to upper surface 54 of body 16. During such driving cf nails 94, body 16 functions to prevent the head of hammer 96 from striking the upper surface of workpiece 14, to prevent hammer marks in workpiece 14 in the event the user misses the nail head while swinging hammer 96. Once nails 94 are driven to this position, the user removes nail starter/shield 10 and uses nail set 12 to complete driving of nails 94 as shown in FIGS. 5*a* and 5*b*. Nail set 12 is first positioned in its FIG. 5*a* position, with tip 88 of head 84 engaging the head of nail 94. The user then employs hammer 96 to strike upper surface 86 of head 84, to fully embed the head of nail 94 into workpiece 14 as shown in FIG. 4*b*.

It is contemplated that nail starter/shield 10 and nail set 12 may be packaged together as a kit, either by themselves or with other tools, for use in installation of deck floor boards. Alternatively, nail starter/shield 10 and nail set 12 can be sold as individual components.

Various alternatives and embodiments are contemplated as being within the scope of the following claims particularly pointing out and distinctly claiming the subject matter regarded as the invention.

I claim:

1. A nailing shield for use in combination with a hammer for driving fasteners such as nails into a workpiece, comprising:

a body;

a head connected to the body, the head including retaining structure for holding one or more nails in a predetermined position over the workpiece, the retaining structure accommodating initial engagement of nails with the workpiece; and a slot formed in the body for receiving the one or more nails therein after initial engagement of the one or more nails with the workpiece, the slot accommodating driving of the nails into the workpiece, wherein the body functions to prevent the hammer from striking the workpiece during driving of the nails.

2. The nailing shield of claim 1, wherein the body defines a first end and a second end, wherein the head is connected to the body at the first end of the body and wherein the slot extends inwardly from the second end of the body.

3. The nailing shield of claim 1, wherein the body extends along a longitudinal axis and the head extends along an axis transverse to the longitudinal axis of the body, and wherein the head defines a forward surface and includes one or more slots extending rearwardly from the forward surface of the head, wherein the one or more nails extend through the slots into engagement with the workpiece.

4. The nailing shield of claim 3, wherein the retaining structure comprises a resilient member mounted to the head over each of the one or more slots, the resilient member including a passage therethrough aligned with each of the one or more slots for receiving the one or more nails.

5. The nailing shield of claim 4, wherein the resilient member comprises a strip of resilient material mounted to the head and extending a length sufficient to encompass each of the one or more slots.

6. The nailing shield of claim 3, wherein the workpiece has a predetermined width and defines a pair of parallel side edges, and wherein at least one of the body and the head defines a pair of side edges spaced apart a distance substantially equal to the predetermined width of the workpiece, whereby aligning the side edges with the side edges of the workpiece functions to position the one or more slots in predetermined locations relative to the workpiece.

7. The nailing shield of claim 6, wherein the pair of side edges are defined by the body and extend throughout substantially the entire length of the body.

8. A combination nail starter and nailing shield for use in combination with a hammer for driving nails into a workpiece, the workpiece having a predetermined width and a pair of parallel spaced side edges, comprising:

a body defining a pair of spaced substantially parallel side edges, the side edges of the body being spaced apart a distance substantially equal to the predetermined width of the workpiece; and nail retaining structure mounted to the body and including one or more openings for receiving one or more nails and for holding the one or more nails in position over the workpiece, the one or more openings being in a predetermined position relative to the side edges of the body;

whereby aligning the side edges of the body with the side edges of the workpiece functions to position the nails at predetermined locations relative to the side edges, of the workpiece.

9. The combination nail starter and nailing shield of claim 8, further comprising a slot formed in the body for receiving the nails therein after initial engagement of the nails with the workpiece, wherein the slot accommodates driving of the nails into the workpiece while the body functions to prevent the hammer from striking the workpiece during driving of the nails.

10. The combination nail starter and nailing shield of claim 9, wherein the body extends along a longitudinal axis and defines a rearward surface transverse to the longitudinal axis, and wherein the slot extends inwardly into the body from the rearward surface of the body in a direction substantially parallel to the longitudinal axis.

11. The combination nail starter and nailing shield of claim 10, wherein the nail retaining structure comprises:

a head mounted to the forward end of the body, the head defining a forward edge;

one or more slots formed in the head extending rearwardly from the forward edge of the head; and resilient material mounted to the head over each slot and including a passage therein aligned with each slot through which a nail extends into the slot.

* * * * *